US012791276B2

(12) United States Patent
Hoffman et al.

(10) Patent No.: US 12,791,276 B2
(45) Date of Patent: Nov. 10, 2026

(54) FIREARM BARREL THAT REDUCES LAUNCH VELOCITY OF BULLETS

(71) Applicant: The United States of America, as Represented by the Secretary of the Navy, Crane, IN (US)

(72) Inventors: Brian R. Hoffman, Bloomington, IN (US); Robert Caprara, Fairfax, VA (US); Lucas LaFontaine, Bloomington, IN (US)

( * ) Notice: Subject to any disclaimer, the term of this patent is extended or adjusted under 35 U.S.C. 154(b) by 0 days.

(21) Appl. No.: 18/784,124

(22) Filed: Jul. 25, 2024

(65) Prior Publication Data

US 2025/0123070 A1 Apr. 17, 2025

Related U.S. Application Data

(60) Provisional application No. 63/528,671, filed on Jul. 25, 2023.

(51) Int. Cl.
*F41A 21/28* (2006.01)
*F41A 21/18* (2006.01)
*F41A 21/30* (2006.01)

(52) U.S. Cl.
CPC ..... *F41A 21/28* (2013.01); *F41A 21/18* (2013.01); *F41A 21/30* (2013.01)

(58) Field of Classification Search
CPC ..... F41A 21/18; F41A 21/28
USPC ..... 42/78
See application file for complete search history.

(56) References Cited

U.S. PATENT DOCUMENTS 1,329,444 A * 2/1920 Thompson ..... F41A 21/16 42/78
2,967,369 A * 1/1961 Musser ..... F42B 14/02 42/78
4,058,050 A * 11/1977 Brouthers ..... F41A 21/36 89/14.3
4,232,605 A * 11/1980 Lair ..... F42B 23/16 102/404
4,590,698 A * 5/1986 Finn ..... F41A 21/28 42/76.01

FOREIGN PATENT DOCUMENTS

GB 2064075 A * 6/1981 ..... F41F 1/00

* cited by examiner

*Primary Examiner* — Bret Hayes
(74) *Attorney, Agent, or Firm* — Naval Surface Warfare Center, Crane Division; Christopher Feigenbutz

(57) ABSTRACT

Disclosed is a firearm barrel that includes a bore, a rifling pattern along a length of the bore, and a grooved gas-venting pattern along a length of the bore that exceeds an envelope of the rifling pattern. The rifling pattern imparts spin on a bullet to stabilize the bullet in flight, while the grooved gas-venting pattern allows expanding propellant gases to escape around the bullet as it travels down the bore, causing a reduction in internal pressure acting on the bullet and reducing bullet velocity. The inventive barrel can reduce bullet velocity of standard ammunition, such as 5.56×45 mm NATO or 7.62×51 mm NATO to a subsonic velocity, or approximately 1125 feet per second at sea level without the need for specialized ammunition.

15 Claims, 11 Drawing Sheets

FIREARM BARREL THAT REDUCES LAUNCH VELOCITY OF BULLETS

CROSS-REFERENCE TO RELATED APPLICATIONS

The present application claims priority to U.S. Provisional Patent Application Ser. No. 63/528,671, filed Jul. 25, 2023, entitled "FIREARM BARREL THAT REDUCES THE LAUNCH VELOCITY OF BULLETS," the disclosure of which is expressly incorporated by reference herein.

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon. This invention (Navy Case 211598) is assigned to the United States Government and is available for licensing for commercial purposes. Licensing and technical inquiries may be directed to the Technology Transfer Office, Naval Surface Warfare Center Crane, email: Crane_T2@navy.mil.

FIELD OF THE INVENTION

The field of invention relates generally to firearms. More particularly, it pertains to a firearm barrel that reduces the launch velocity of bullets used in standard supersonic cartridges to subsonic levels.

BACKGROUND

At the shooter's location, the sound produced from firing unsuppressed small arms can regularly exceed 160 dB, which is loud enough to damage human hearing. One of the main factors that causes the damaging level of sound is the bullet exiting the barrel at a velocity that is faster than the speed of sound (otherwise known as supersonic, or approximately 1125 feet per second at sea level). One means to decrease the sound signature of a projectile is to utilize subsonic ammunition (ammunition with a velocity below 1125 feet per second at sea level). As can be appreciated, subsonic fire in small arms is a useful capability where maximum audible signature reduction benefits concealment and/or improved ability to communicate within a group. This reduction in sound is traditionally accomplished with the use of specialized subsonic ammunition, which utilizes cartridges assembled with heavier bullets, reduced charge weight of propellant, or a combination thereof. While functionally adequate, specialized subsonic ammunition is less common than standard, supersonic ammunition, which can lead to logistical and supply related challenges, particularly in military and law enforcement scenarios. As such, operators needing specialized ammunition may not be able to acquire it in time or in sufficient quantity. Additionally, not all operational units may be authorized to request specialized subsonic ammunition.

Another means of reducing the sound signature of a bullet is to decrease the launch velocity of the bullet in standard, supersonic ammunition to subsonic velocities. Past developmental approaches to achieve such a reduction relied on gas venting features, such as holes or slots implemented orthogonally to the bore and leading to an enclosed outer expansion volume. The expansion volume is established through a barrel assembly that includes the rifled gun tube and a sealed outer barrel jacket. This approach, while shown to be functionally viable, suffers from design integration and form/fit difficulties due to its notable increase in physical envelope, increased mass, and center of gravity implications affecting general balance of the weapon. Additionally, the jacketed barrel design approach makes regular cleaning and maintenance a time consuming task due to the need for partial barrel system disassembly in order to access and clean the areas in and around the expansion volume.

As shown above, it is clear that a new means for reducing standard ammunition velocity is needed.

SUMMARY OF THE INVENTION

The present invention relates to a firearm barrel that reduces the launch velocity of bullets used in standard supersonic cartridges to subsonic levels. Disclosed is a firearm barrel that includes a bore, a grooved rifling pattern along a length of the bore, and a grooved gas-venting pattern along a length of the bore that exceeds an envelope of the grooved rifling pattern. The grooved rifling pattern imparts spin on a bullet to stabilize the bullet in flight, while the grooved gas-venting pattern allows expanding propellant gases to escape around the bullet as it travels down the bore, causing a reduction in internal pressure acting on the bullet and reducing bullet velocity. The velocity reduction eliminates the "crack" of the gunshot caused by the bullet breaking the speed of sound. Additionally, the inventive barrel can be utilized with a sound suppression device to allow for maximum audible signature reduction during firing to enable subsonic suppressed fire. The inventive barrel can reduce bullet velocity of standard ammunition, such as 5.56×45 mm NATO or 7.62×51 mm NATO to a subsonic velocity without the need for specialized subsonic ammunition.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

Figure 1A:
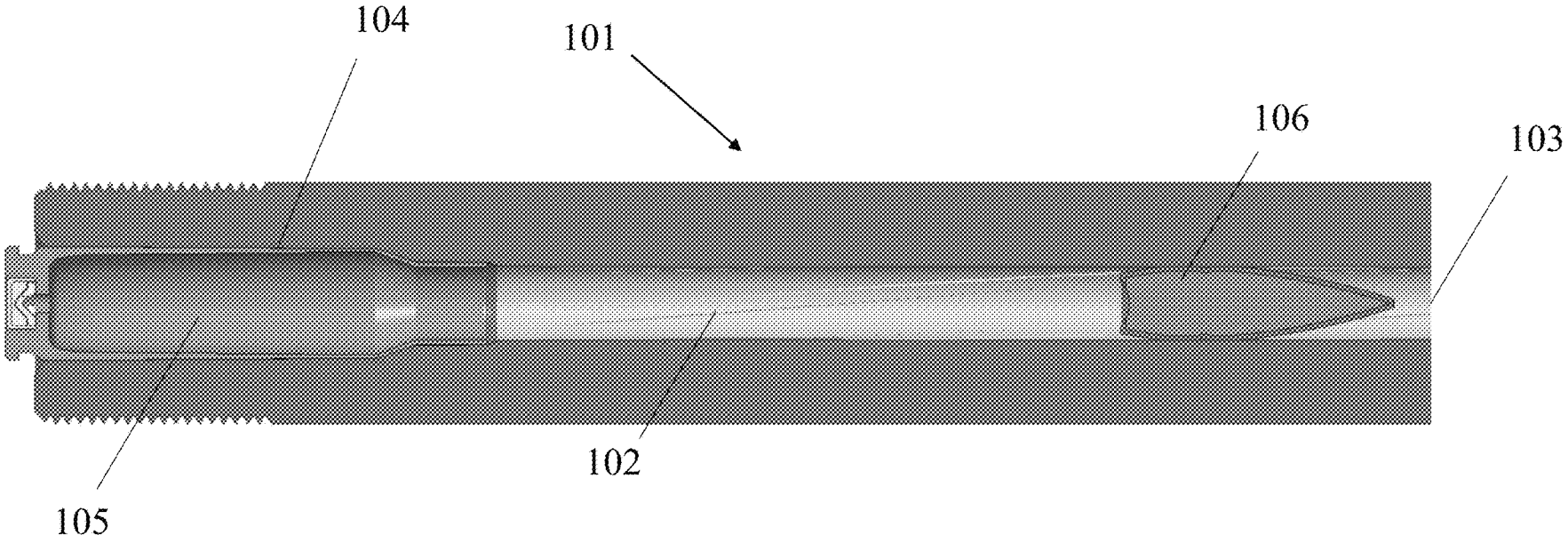
FIG. 1A (Prior Art)
FIG. 1A shows a cross section view of a prior art rifled barrel.

The embodiments of the invention described herein are not intended to be exhaustive or to limit the invention to precise forms disclosed. Rather, the embodiments selected for description have been chosen to enable one skilled in the art to practice the invention.

Generally, provided is a firearm barrel comprising: a bore; a grooved rifling pattern along a length of the bore; and a grooved gas-venting pattern along a length of the bore that exceeds an envelope of the grooved rifling pattern; wherein the rifling pattern imparts spin on a bullet to stabilize the bullet in flight; and wherein the grooved gas-venting pattern allows expanding propellant gases to escape around the bullet as it travels down the bore, causing a reduction in internal pressure acting on the bullet and reducing bullet velocity.

In an illustrative embodiment, the grooved gas-venting pattern comprises one or more added linear grooves along the length of the bore. In an illustrative embodiment, the grooved gas-venting pattern comprises one or more tapered linear grooves along the length of the bore. In an illustrative embodiment, the grooved gas-venting pattern comprises one or more helical grooves along the length of the bore. In an illustrative embodiment, the grooved gas-venting pattern is added via wire Electrical Discharge Machining. In an illustrative embodiment, the grooved gas-venting pattern is added via hammer forging. In an illustrative embodiment, the grooved gas-venting pattern is added via cut rifling. In an illustrative embodiment, the grooved gas-venting pattern is added via button rifling. In an illustrative embodiment, the grooved gas-venting pattern is added via button rifling. In an illustrative embodiment, the grooved gas-venting pattern is added via broach rifling. In an illustrative embodiment, the grooved gas-venting pattern is added via sinker EDM. In an illustrative embodiment, the grooved gas-venting comprises grooves implemented as tapered features along a partial length of the bore. In an illustrative embodiment, the grooved gas-venting pattern comprises grooves terminating prior to reaching a gas port. In an illustrative embodiment, the firearm barrel is utilized with a sound suppressor. In an illustrative embodiment, the grooved gas-venting pattern comprises gas venting grooves axially centered about the rifling pattern. In an illustrative embodiment, the gas-venting grooves are radially centered to said rifling pattern grooves and being larger in diameter. In an illustrative embodiment, the gas-venting grooves are radially centered to said rifling pattern grooves and narrower in width. In an illustrative embodiment, the grooved gas-venting pattern comprises helical grooves of partial or full length along the barrel bore. In an illustrative embodiment, the helical grooves of partial or full length further comprise uniform outer diameter. In an illustrative embodiment, the helical grooves of partial or full length further comprise a decaying outer diameter.

In an illustrative embodiment, provided is a firearm barrel comprising: a bore; and a grooved gas-venting pattern along a length of the bore; wherein the grooved gas-venting pattern allows expanding propellant gases to escape around the bullet as it travels down the bore, causing a reduction in internal pressure acting on the bullet and reducing bullet velocity.

In an illustrative embodiment, the grooved gas-venting pattern comprises one or more added linear grooves along the length of the bore. In an illustrative embodiment, the grooved gas-venting pattern comprises one or more tapered linear grooves along the length of the bore. In an illustrative embodiment, the grooved gas-venting pattern comprises one or more helical grooves along the length of the bore. In an illustrative embodiment, the grooved gas-venting pattern is added via wire Electrical Discharge Machining. In an illustrative embodiment, the grooved gas-venting pattern is added via hammer forging. In an illustrative embodiment, the grooved gas-venting pattern is added via cut rifling. In an illustrative embodiment, the grooved gas-venting pattern is added via button rifling. In an illustrative embodiment, the grooved gas-venting pattern is added via broach rifling. In an illustrative embodiment, the grooved gas-venting pattern is added via sinker EDM. In an illustrative embodiment, the grooved gas-venting comprises grooves implemented as tapered features along a partial length of the bore. In an illustrative embodiment, the grooved gas-venting pattern comprises grooves terminating prior to reaching a gas port. In an illustrative embodiment, the firearm barrel is utilized with a sound suppressor. In an illustrative embodiment, the grooved gas-venting pattern comprises helical grooves of partial or full length along the barrel bore. In an illustrative embodiment, the helical grooves of partial or full length further comprise uniform outer diameter. In an illustrative embodiment, the helical grooves of partial or full length further comprise a decaying outer diameter.

Figure 1C:
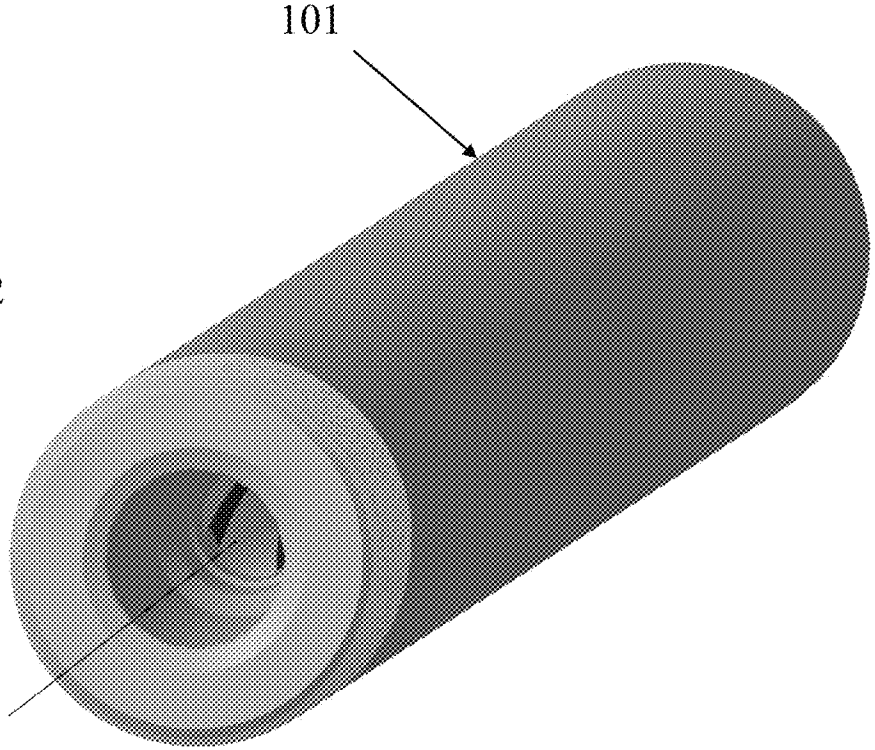
FIG. 1C (Prior Art)
FIG. 1C shows a perspective view of a prior art rifled barrel.
Figure 1B:
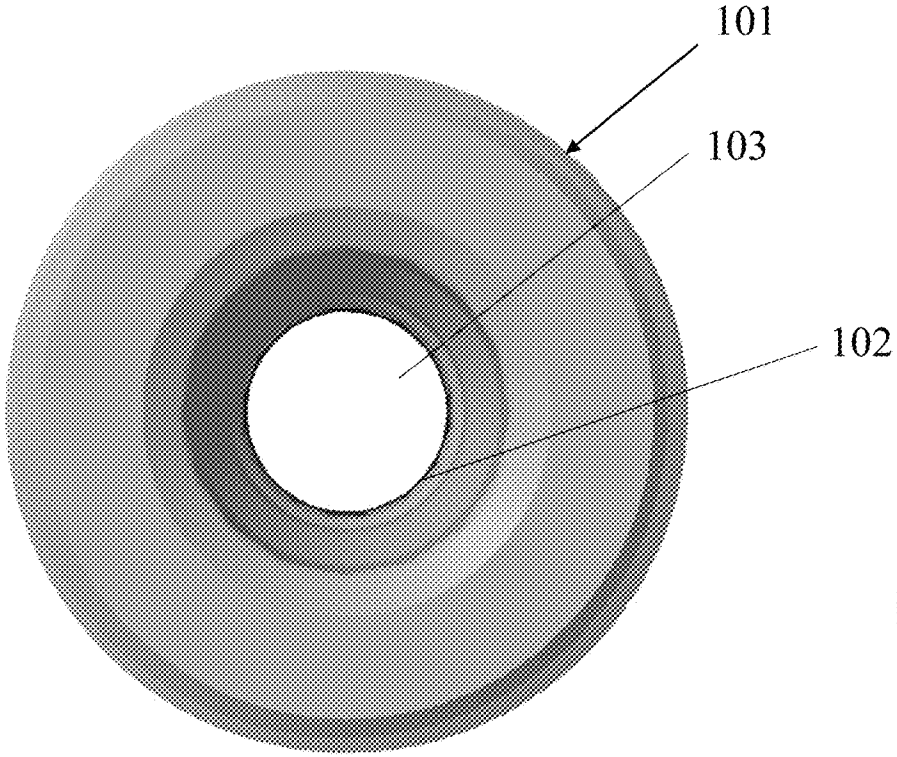
FIG. 1B (Prior Art)
FIG. 1B shows a frontal view of a prior art rifled barrel.

FIGS. 1A-1C show views of a prior art rifled barrel 101. Here is shown a conventional firearm barrel 101 that is well known in the art, comprising a grooved rifling pattern 102 along a length of the bore 103. The terms "grooved rifling pattern," "rifling pattern," and "rifling pattern groves" are used interchangeably throughout, and generally refer to rifling features implemented within a barrel bore that exist to impart rotation to a bullet as it travels down a bore. Examples of grooved rifling patterns include, but are not limited to, conventional land-and-groove style rifling, variable/gain/progressive twist style rifling, and polygonal rifling.

Specifically, shown in FIG. 1 is an integral cartridge chamber 104 along with a rifling pattern 102 (in this case, a land-and-groove style rifling pattern) forward of the cartridge chamber 104 and along the entire length of the bore 103, a cartridge case 105 in the chamber 104 and a bullet 106 within the bore 103. This design is well known in the art and is used to impart spin to a bullet 106 as it exits the bore 103 of the barrel 101. Spin helps to stabilize the bullet in flight to improve accuracy when compared to smooth bore barrels.

As can be appreciated, a bullet 106 is designed to engage a bore 103 in a way that facilitates a seal between the bore 103 and bullet 106 in order to prevent gases from escaping around the bullet 106 as it travels down the bore 103. After firing, the bullet 106 travels down the bore 103, and the grooved rifling pattern 102 is engraved upon the bullet 106, which causes angular acceleration (rotation or spin) of the bullet 106 within the bore 103. The pressure buildup behind the bullet 106 causes the bullet 106 to continue down the bore 103, while the grooved rifling pattern 102 causes the bullet 106 to continue to spin. Rotation continues once the bullet 106 exits the bore 103, providing stability in flight.

Figure 2:
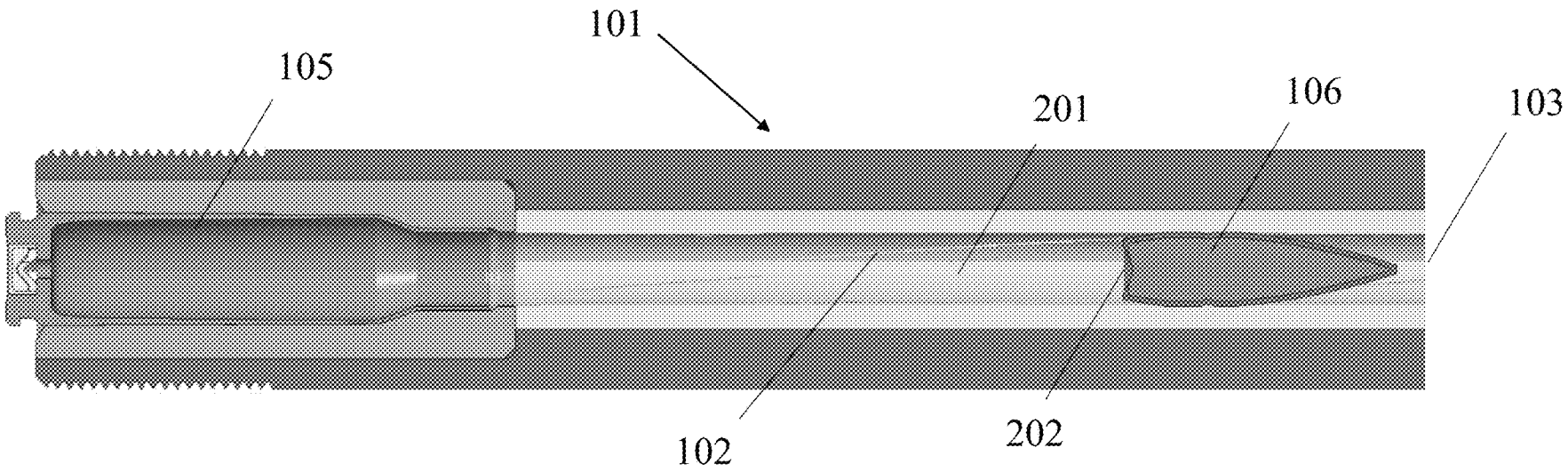
FIG. 2 shows a cross section view of a firearm barrel with a grooved rifling pattern along a length of the bore and a linear grooved gas-venting pattern along a length of the bore.
Figure 3B:
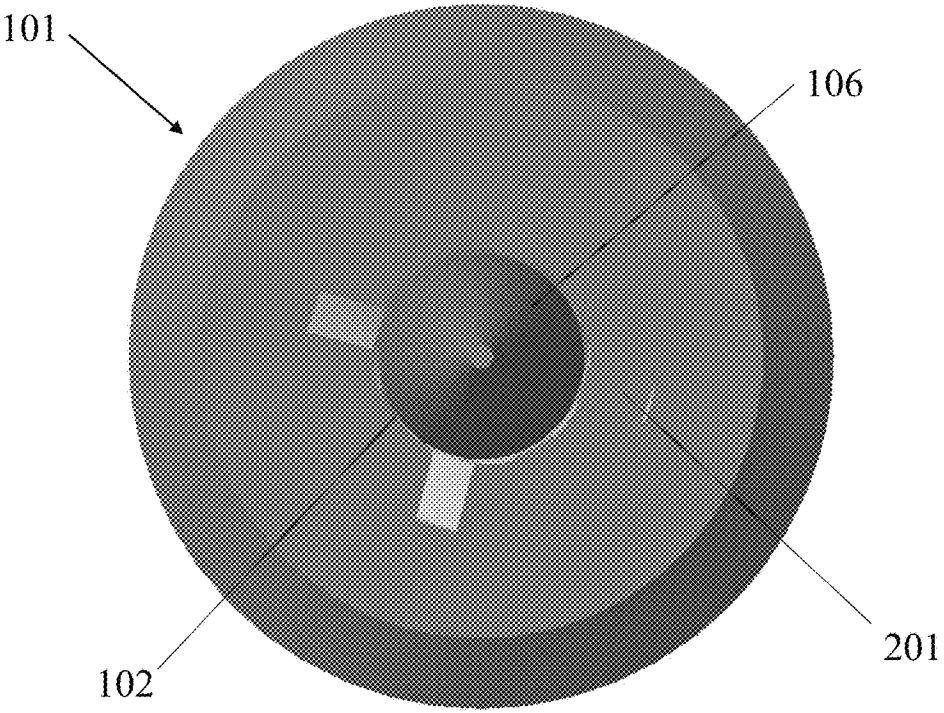
FIG. 3B shows a rear view of a grooved gas-venting pattern axially centered about a grooved rifling pattern with a bullet in the bore.
Figure 3A:
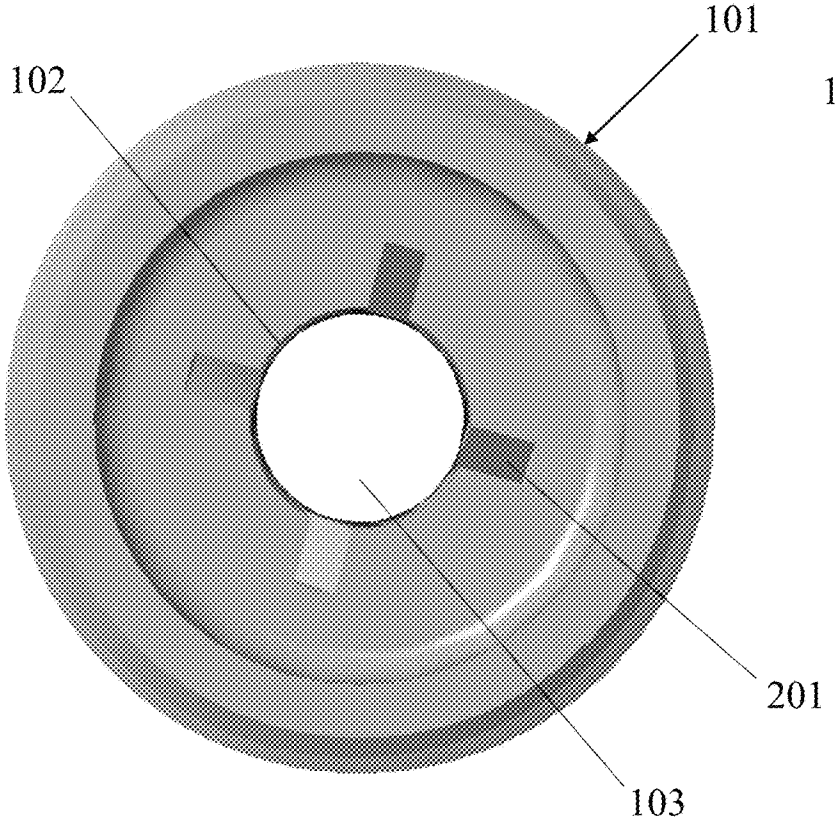
FIG. 3A shows a frontal view of a grooved gas-venting pattern axially centered about a grooved rifling pattern.

FIG. 2 shows a cross section view of a firearm barrel 101 with a grooved rifling pattern 102 along a length of the bore 103 and a grooved gas-venting pattern 201 along a length of the bore 103, FIG. 3A shows a frontal view of a grooved gas-venting pattern 201 axially centered about a grooved rifling pattern 102, and FIG. 3B shows a rear view of a grooved gas-venting pattern 201 axially centered about a grooved rifling pattern 102 with a bullet 106 in the bore 103. In an illustrative embodiment, the firearm barrel 101 comprises a bore 103, a grooved rifling pattern 102 along a length of the bore 103, and a grooved gas-venting pattern 201 along a length of the bore 103 that exceeds an envelope (dimensions) of the rifling pattern 102. In an illustrative embodiment, the grooved rifling pattern 102 imparts spin on a bullet 106 to stabilize the bullet 106 in flight as described above. In an illustrative embodiment, the grooved gas-venting pattern 201 allows expanding propellant gases to escape around the bullet 106 as it travels down the bore 103, causing a reduction in internal pressure acting on the bullet 106 and reducing bullet velocity. In an non-limiting embodiment, the design of the grooved gas-venting pattern 201 differs from a conventional grooved rifling pattern 102 since it is designed to allow expanding propellant gases to escape around the bullet 106 as it travels down the bore 103, whereas the grooved rifling pattern 102 imparts spin while preventing expanding propellant gases from escaping around the bullet 106 as it travels down the bore 103. The escaping gases caused by the grooved gas-venting pattern 201 reduces pressure on the base 202 of the bullet 106, which reduces launch velocity. In an illustrative embodiment, the launch velocity can be reduced to below the speed of sound (approximately 1125 feet per second at sea level).

Figure 4:
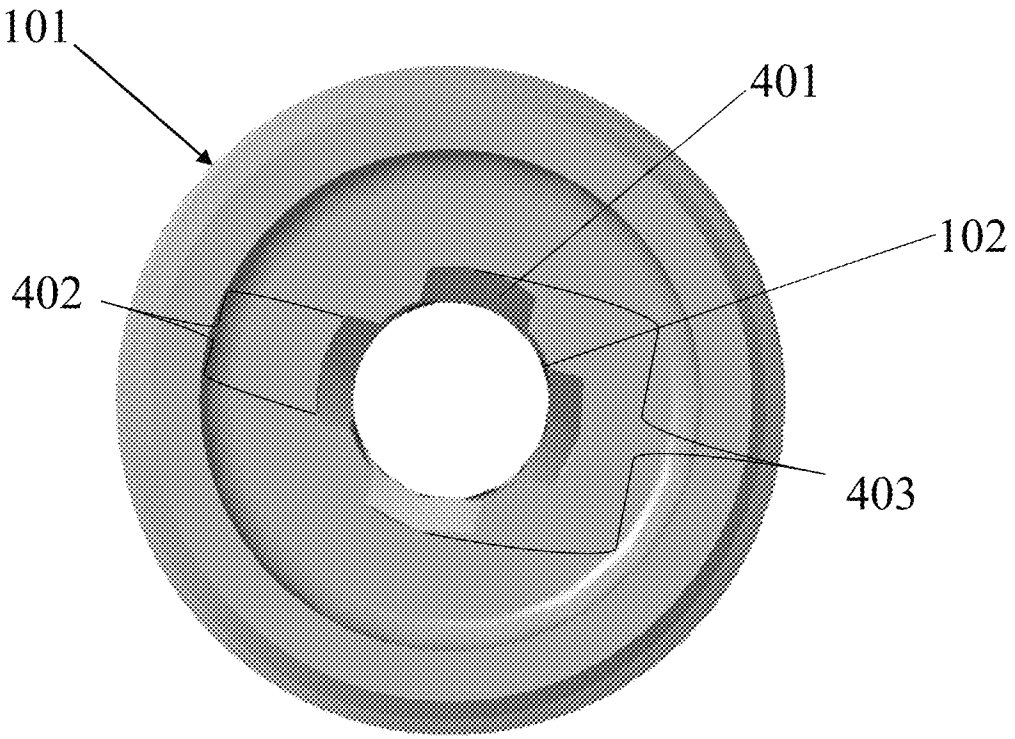
FIG. 4 shows a frontal view of a helical gas-venting pattern with an equivalent width and increased outer diameter relative to rifling pattern grooves.
Figure 5:
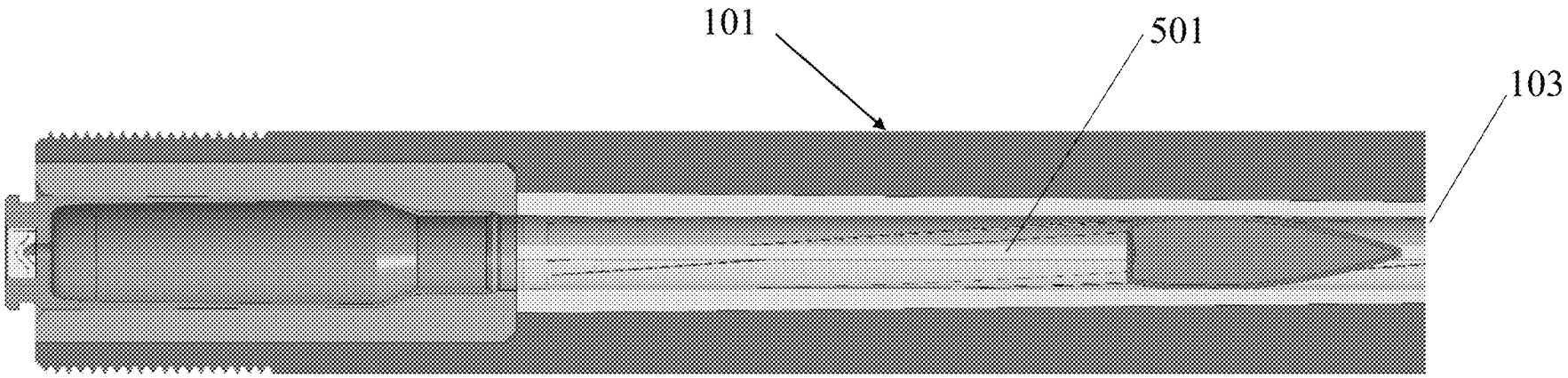
FIG. 5 shows a cross section view of a tapered linear grooved gas-venting pattern along a length of a bore.

FIG. 4 shows a frontal view of a helical gas-venting pattern 401 with an equivalent width 402 and increased outer diameter 403 relative to rifling pattern grooves 102. As described above, grooves that exceed the rifling pattern grooves 102 allow for expanding propellant gases to escape around the bullet 106 as it travels down the bore 103. The venting of gas reduces pressure on the base 202 of the bullet 106 (as shown in FIG. 2), which reduces launch velocity. In an illustrative embodiment, the grooved gas-venting 201 pattern can be implemented in a variety of ways. Shown in FIG. 4 is a helical gas-venting pattern 401 with an equivalent width 402 and increased outer diameter 403 relative to rifling pattern grooves 102. In an alternate embodiment, as shown in FIG. 5, the grooved gas-venting pattern can comprise one or more added linear tapered grooves 501 along the length of the bore 103.

Figure 6A:
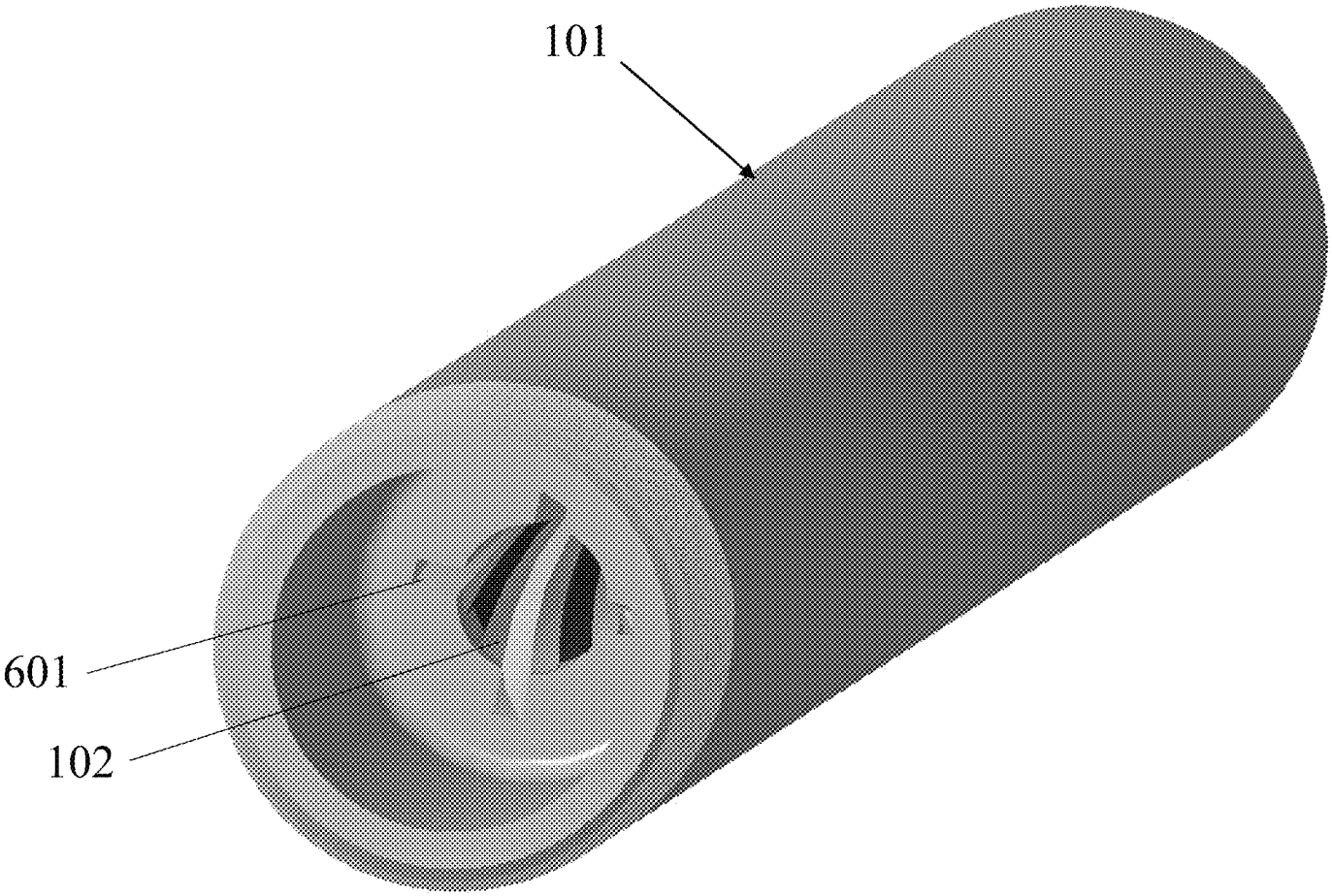
FIG. 6A shows a perspective view of a barrel with a helical gas-venting pattern a length of a bore.
Figure 6B:
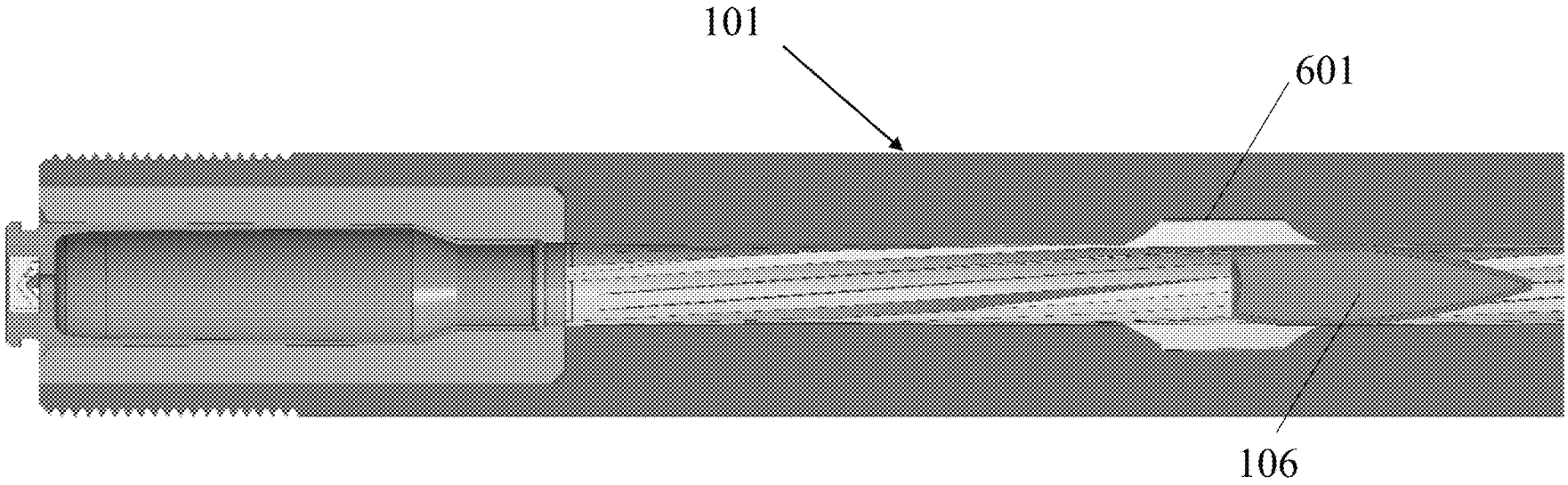
FIG. 6B shows a cross section view of a helical grooved gas-venting pattern along a length of a bore.

In an alternate embodiment, as shown in FIG. 6A, the grooved gas-venting pattern can comprise one or more added helical grooves 601 along the length of the bore 103, and in FIG. 6B, the grooved gas-venting pattern can comprise a tapered grooved gas-venting pattern 601 along a length of a bore 103. In an illustrative embodiment, one or more added helical grooves 601 (in this non-limiting example, shown are four added helical grooves 601), comprise an outer diameter that exceeds the diameter of the grooved rifling pattern 102, which allows for expanding propellant gases to escape around a bullet as it travels down the bore 103. In an illustrative embodiment, the helical grooves 601 can be added at the same twist rate as the existing grooved rifling pattern 102 (i.e., 1 full rotation/twist in 7 inches, etc.). In an illustrative embodiment, when each helical groove 601 is narrower than the existing grooved rifling pattern 102, then each helical groove 601 is approximately centered about the rifling pattern grooves 102. In such an embodiment, the helical groove 601 will provide the necessary gas venting while the grooved rifling pattern 102 imparts spin to provide sufficient bullet stability. That is, the helical grooves 601 allow for uninterrupted contact between bullet and grooved rifling pattern 102 as the bullet travels down the bore.

Figure 7:
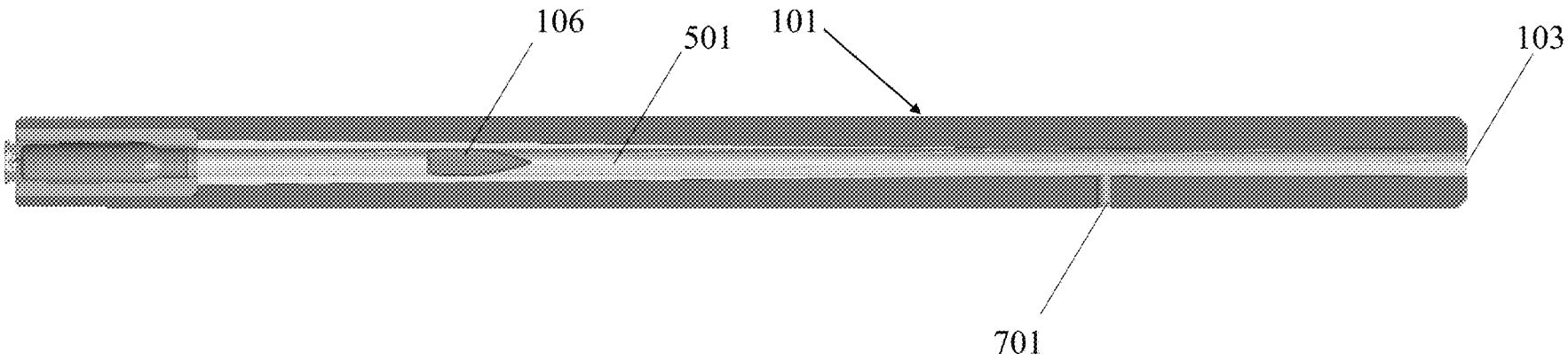
FIG. 7 shows a cross section view of a tapered linear grooved gas-venting pattern along a length of a bore terminating prior to reaching a gas port.

In still another alternative embodiment, as shown in FIG. 7, the grooved gas-venting pattern can comprise one or more added tapered linear grooves along the length of the bore 103 and terminating prior to reaching the gas port 701. In an illustrative embodiment, a gas port 701 is shown with the tapered linear grooves 501 terminating prior to reaching the gas port 701. A gas port 701 is a common feature for self-powered, gas-operated weapons and channels a percentage of the gas pressure developed during firing to other components of weapon's operating group to permit reliable automatic cycling. Since gas venting ends prior to the gas port location, once the bullet 106 passes the gas port 701 it will still generate sufficient pressure in the gas system to reliably auto cycle the weapon. As can be appreciated, the tapered linear gas venting grooves 501 not only aid with accommodating automatic cycling in gas-operated weapon systems, but they also allow for a prescribed reduction in gas venting cross-sectional area along the partial length of the barrel 101 that includes the grooves, which may be considered a beneficial attribute in certain applications independent of whether or not auto cycling is a functional requirement. In an illustrative embodiment, helical gas venting grooves of constant or decaying outer diameter that terminate prior to a gas port can be utilized in any embodiment described herein to realize similar auto cycling benefits in self-powered, gas-operated weapons.

Figure 8:
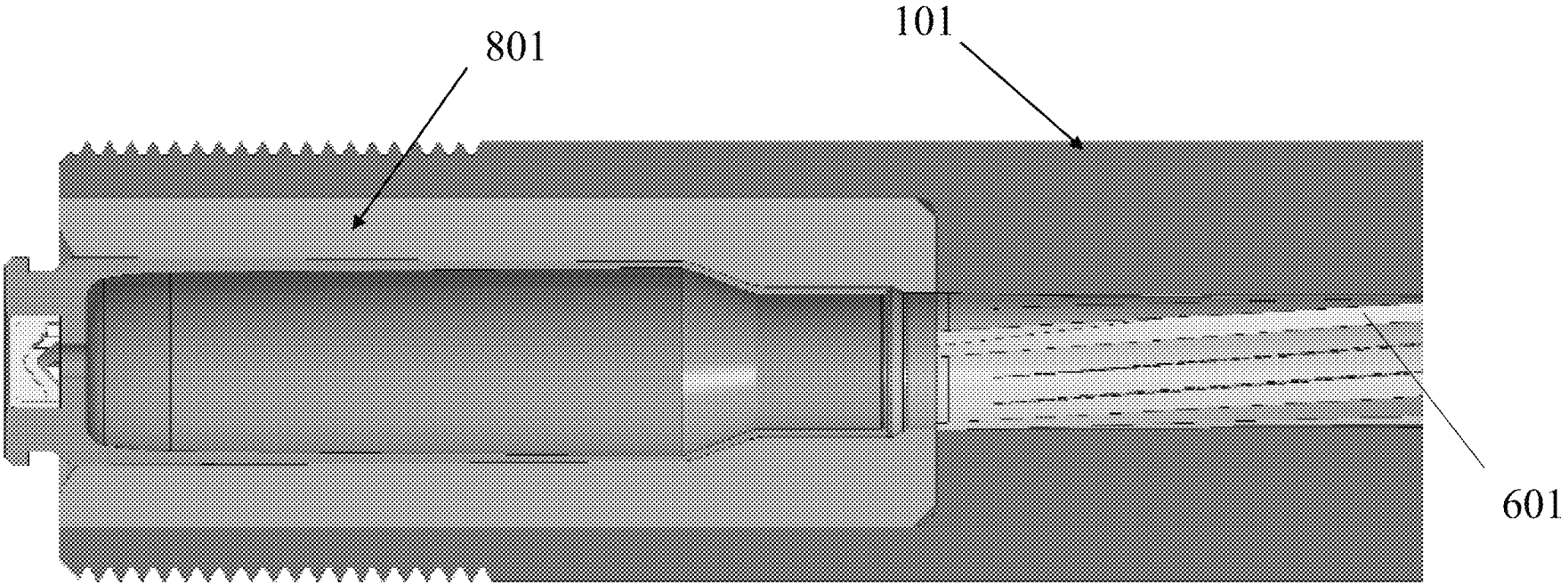
FIG. 8 shows a view of a cartridge chamber incorporated as a separate component.

FIG. 8 shows a view of a cartridge chamber 801 incorporated as a separate component. In many applications, the cartridge chamber 801 will be incorporated as a separate component. In an illustrative embodiment, the separate chamber 801 can be coupled via threads or press fit as example attachment methods to the barrel system 101 after the helical grooved gas venting features 601 are incorporated in order to avoid any unwanted structural modification to the cartridge chamber 901. In an illustrative embodiment, a separate cartridge chamber 901 may also be utilized in order to allow for gas venting features of sufficient diameter without compromising the structural integrity and continuity of chamber (if the cartridge chamber were integral to the barrel prior to implementing the gas venting features). In an illustrative embodiment, use of a separate cartridge chamber 801 can be implemented with any of the embodiments described herein, including but not limited to linear gas venting grooves and tapered linear gas venting grooves.

Figure 9:
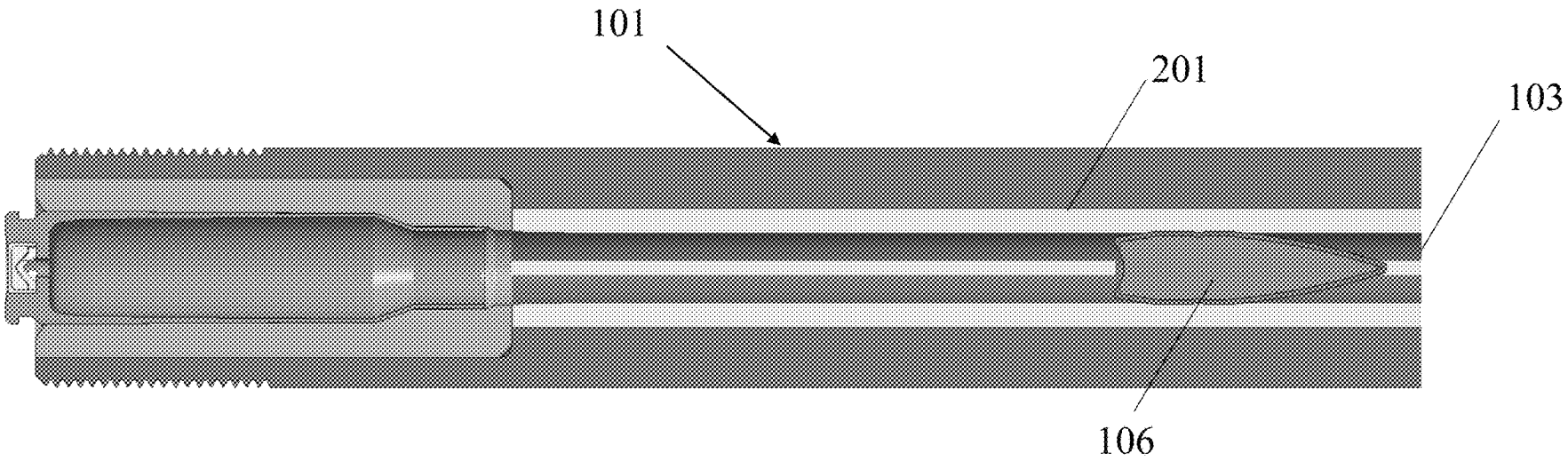
FIG. 9 shows a cross section view of a firearm barrel with a gas-venting pattern along a length of the bore

FIG. 9 shows a cross section view of a firearm barrel 101 with a gas-venting pattern along 201 a length of the bore 103. In an illustrative embodiment, the grooved gas-venting pattern 201 as shown in FIG. 2 can be utilized with a firearm barrel 101 devoid of a conventional rifling pattern (also known as a smooth bore barrel). In such an embodiment, the grooved gas-venting pattern 201 allows expanding propellant gases to escape around a bullet 106 as it travels down the bore 103, causing a reduction in internal pressure acting on the bullet 106 and reducing bullet velocity.

In an illustrative embodiment, the gas venting grooves can be added to the barrel as a retrofit modification to an existing barrel or incorporated directly during new barrel production. In an illustrative embodiment, the grooved gas-venting pattern is added via wire Electrical Discharge Machining. In an illustrative embodiment, the grooved gas-venting pattern is added via hammer forging. In an illustrative embodiment, the grooved gas-venting pattern is added via cut rifling. In an illustrative embodiment, the grooved gas-venting pattern is added via button rifling. In an illustrative embodiment, the grooved gas-venting pattern is added via broach rifling. In an illustrative embodiment, the grooved gas-venting pattern is added via sinker EDM. In an illustrative embodiment, the grooved gas-venting comprises grooves implemented as tapered features along a partial length of the bore.

As can be appreciated, the inventive barrel design can be utilized with a centerfire, rifle-sized bottleneck caliber (such as 5.56×45 mm NATO or 7.62×51 mm NATO), which in many applications implies a substantial bullet velocity reduction in excess of 1,500 ft/s in order to reach subsonic velocity. The required velocity drop is significant and much more dramatic than other limited historical examples of bullet velocity reduction methods, which are known to exist in some pistol caliber systems that can only need to reduce relative velocities by a few hundred feet per second (and also use gas venting holes or slots implemented orthogonally to the bore).

In an illustrative embodiment, the inventive barrel can be utilized with a number of weapon systems, including precision rifles, automatic rifles, machine guns that offer tool less or quick-change barrel/caliber and/or upper receiver modularity. Such weapon platforms create opportunities for special purpose barrel designs and uses that may not have been previously considered viable. The ability to easily change barrels makes it far more appealing to selectively integrate and use, as mission expectations dictate, a special purpose barrel like the inventive barrel that offers a dedicated subsonic fire capability.

In an illustrative embodiment, the size, shape, and depth of the gas vent can be custom tailored to the weapon system, cartridge, barrel length, and the like to ensure the desired reduction in velocity is achieved. While the benefit of the inventive barrel is primarily anticipated in its ability to enable subsonic bullet launch, a less dramatic bullet launch velocity reduction can also be readily achieved for applications benefitting from slower, but still supersonic, bullet launch velocities.

In an illustrative embodiment, the inventive barrel enables subsonic fire without requiring specialized subsonic ammunition. In an illustrative embodiment, the inventive barrel facilitates a reduction in bullet launch velocity of standard (supersonic) ammunition as the gas venting method is internal to the barrel bore. In an illustrative embodiment, the inventive barrel does not require an outer enclosed expansion volume and barrel jacket, which are required elements of prior methods involving gas venting features implemented orthogonally to the bore axis and through the sidewall of the barrel. In an illustrative embodiment, the inventive barrel does not require additional components beyond existing baseline barrel and only one additional feature/feature set), an increase in physical envelope (important for integrating this barrel option into an existing weapon system without other part modifications), additional mass (inventive design actually removes some mass from existing barrel), any significant change to integrated system center of gravity and weapon balance, and additional maintenance and cleaning (no disassembly/reassembly process required).

In an illustrative embodiment, the inventive barrel is not limited to long gun applications, rifle-sized cartridges, or bottleneck cartridge configurations. In an illustrative embodiment, the inventive barrel is not limited to barrels with conventional land-and-groove rifling (as the inventive design can be utilized with barrels of other rifling types such as polygonal or gain-twist, or smoothbore gun barrels). Lastly, in an alternative embodiment, other potential fabrication options available to implement identical or similar gas venting features of the described unique configurations are contemplated.

In an illustrative embodiment, the inventive barrel can be used in various hunting applications where subsonic suppressed firearms are allowed and especially in more "suburban" areas where hunting with reduced noise is preferable. Additionally, the inventive barrel may appeal to recreational shooters who want to fire subsonic or subsonic suppressed without purchasing specialized subsonic ammunition, which can be more expensive and/or not as readily available than many standard ammunition types.

In an illustrative embodiment, the inventive barrel can be used in commercial marksmanship training centers or events, for law enforcement agencies or civilian recreational shooters, where subsonic fire is preferred due to noise reduction advantages and/or reduced effective range. As can be appreciated, reduced range can translate into smaller footprint of designated safe firing zones and reduced risk of collateral damage from unexpected errant shots. Both factors could positively influence overall risk posture for liability insurance and related expenses. In some cases and depending on the target types involved, lower bullet launch velocity can also translate into increased target life, which can be a favorable economic consideration for marksmanship/training related businesses.

In an illustrative embodiment, the inventive barrel utilized in an unsuppressed configuration (i.e. subsonic bullet launch only and without pairing the inventive barrel with a sound suppressor) may be a useful reduced range, lower collateral damage option for counter unmanned system and especially counter unmanned aerial system applications.

Although the invention has been described in detail with reference to certain preferred embodiments, variations and modifications exist within the spirit and scope of the invention as described and defined in the following claims.

The invention claimed is:

1. A velocity reducing barrel for a gas-operated autocycling firearm, comprising:

a bore;

a rifling pattern along a length of said bore that imparts spin on a bullet to stabilize said bullet in flight;

a gas port that channels a percentage of gas pressure developed during firing to permit reliable automatic cycling; and a grooved gas-venting pattern along a length of said bore that exceeds an envelope of said rifling pattern to allow expanding propellant gases to escape around said bullet to reduce bullet launch velocity;

wherein said grooved gas-venting pattern terminates prior to reaching said gas port to enable generation of sufficient pressure in said gas port to reliably auto cycle said weapon.

2. The device of claim 1, wherein said grooved gas-venting pattern comprises one or more added linear grooves along said length of said bore.

3. The device of claim 1, wherein said grooved gas-venting pattern comprises one or more helical grooves along said length of said bore.

4. The device of claim 1, wherein said grooved gas-venting pattern is added via wire Electrical Discharge Machining.

5. The device of claim 1, wherein said grooved gas-venting pattern is added via hammer forging.

6. The device of claim 1, wherein said grooved gas-venting pattern is added via cut rifling.

7. The device of claim 1, wherein said grooved gas-venting pattern is added via button rifling.

8. The device of claim 1, wherein said grooved gas-venting pattern is added via broach rifling.

9. The device of claim 1, wherein said grooved gas-venting pattern is added via sinker EDM.

10. The device of claim 1, wherein said grooved gas-venting comprises grooves implemented along a partial length of said bore.

11. The device of claim 1, wherein said grooved gas-venting pattern comprises gas venting grooves axially centered about said rifling pattern.

12. The device of claim 11, wherein said gas-venting grooves are axially centered to said rifling pattern grooves.

13. The device of claim 1, wherein said gas-venting grooves allow expanding propellant gases to escape around said bullet to enable subsonic bullet launch.

14. The device of claim 1, wherein said grooved gas-venting pattern comprises helical grooves of partial or full length along said barrel bore.

15. The device of claim 14, wherein said helical grooves of partial or full length further comprise uniform outer diameter.

* * * * *